US011036187B2

(12) United States Patent
Iguchi

(10) Patent No.: US 11,036,187 B2
(45) Date of Patent: Jun. 15, 2021

(54) TIMEPIECE INCLUDING A STOP MEMBER ROTATABLY MOUNTED TO A BEZEL

(71) Applicant: Seiko Instruments Inc., Chiba (JP)

(72) Inventor: Katsunobu Iguchi, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/822,452

(22) Filed: Mar. 18, 2020

(65) Prior Publication Data

US 2020/0310351 A1 Oct. 1, 2020

(30) Foreign Application Priority Data

Mar. 25, 2019 (JP) ..... JP2019-056659

(51) Int. Cl.
*G04B 37/00* (2006.01)

(52) U.S. Cl.
CPC ..... *G04B 37/0008* (2013.01)

(58) Field of Classification Search
CPC ..... G04B 37/0008; G04B 37/148; G04B 37/0445; G04B 37/0427; G04G 17/045; G04G 17/08
USPC ..... 368/295
See application file for complete search history.

(56) References Cited

U.S. PATENT DOCUMENTS 2,082,843 A * 6/1937 Mathez ..... G04B 27/045 368/192
8,289,815 B2 * 10/2012 Gracia ..... G04B 37/148 368/88
2007/0189127 A1 * 8/2007 Pollak ..... G04B 37/1486 368/294
2007/0253290 A1 * 11/2007 Aire ..... G04B 39/00 368/294
2008/0144446 A1 * 6/2008 Karterman ..... G04G 17/045 368/88

FOREIGN PATENT DOCUMENTS

JP 2002189084 A 7/2002

* cited by examiner

*Primary Examiner* — Edwin A. Leon
(74) *Attorney, Agent, or Firm* — Brinks Gilson & Lione

(57) ABSTRACT

A timepiece according to the embodiment of the present invention includes a case band which has an opening on the upper surface side thereof, and which has a recess in an inner peripheral portion thereof; a bezel (windshield bezel) to which a glass (windshield) is fixed and which is mounted to the upper surface side of the case band; a protrusion which is provided at the portion of the bezel inserted into the inner side of the case band and which protrudes toward the inner peripheral portion so as not to enter the recess; and a stop member which is rotatably mounted to the bezel, which is made swingable between the upper side and the lower side of the protrusion by getting over the protrusion while undergoing elastic deformation, and the upper portion of which abuts a ceiling portion of the recess and the lower portion of which abuts the protrusion in a state in which the bezel is mounted to the case band to be respectively engaged with the case band and the bezel.

6 Claims, 10 Drawing Sheets

TIMEPIECE INCLUDING A STOP MEMBER ROTATABLY MOUNTED TO A BEZEL

RELATED APPLICATIONS

This application claims priority to Japanese Patent Application No. 2019-056659, filed on Mar. 25, 2019, the entire content of which is incorporated herein by reference.

BACKGROUND OF THE INVENTION

1. Field of the Invention

An embodiment of the present invention relates to a timepiece.

2. Description of the Related Art

There exists a timepiece of a structure in which after the insertion of a movement with hands and a dial into a case band of the timepiece from the mounting direction of a bezel with respect to the case band, the bezel is mounted to the case band. As an example thereof, there has been disclosed a structure in which the case band and the bezel of a timepiece are fixed in position by using a machine screw (See JP-A-2002-189084).

As a structure for fixing a case band and a bezel in position, apart from the machine screw fixation structure as mentioned above, there is known a structure in which an engagement portion is provided on a foot of the bezel inserted into the case band and in Which the engagement portion is engaged with the case band by utilizing the flexural force of the foot.

However, in the structure in which the engagement portion is engaged with the case band by utilizing the flexural force of the foot of the bezel, as the number of times that the bezel is mounted to and detached from the case band, that is, the number of times that the opening/closing is effected, is increased, there is a fear of the case band or the bezel being scraped. Further, for the case where a material subject to deformation such as gold or a hard material such as titanium is used for the bezel and the case band, the structure in which the engagement portion is engaged with the case band by utilizing the flexural force of the foot of the bezel is rather unsuitable.

SUMMARY OF THE INVENTION

In view of the above fact, it is an object of an embodiment of the present invention to make it possible to comfortably repeat the opening and closing of a bezel with respect to the case band, thereby achieving an improvement in terms of timepiece maintenance property.

According to a first mode of the invention, there is provided a timepiece including a case band which has an opening on an upper surface side thereof, and which has a recess in an inner peripheral portion thereof; a bezel to which a windshield is fixed and which is mounted to the upper surface side of the case band; a protrusion which is provided at a portion of the bezel inserted into an inner side of the case band and which protrudes toward the inner peripheral portion so as not to enter the recess; and a stop member which is rotatably mounted to the bezel, which is made swingable between an upper side and a lower side of the protrusion by getting over the protrusion while undergoing elastic deformation, and an upper portion of which abuts a ceiling portion of the recess and a lower portion of which abuts the protrusion in a state in which the bezel is mounted to the case band to be respectively engaged with the case band and the bezel.

In this timepiece, the stop member is rotatably mounted to the bezel. When accommodating the movement in the case band and mounting the bezel to the case band, a foot portion of the bezel is inserted into the case band. At this time, the protrusion provided on the foot portion protrudes so as not to enter the recess, so that it does not easily interfere with the inner peripheral portion of the case band. Further, at this time, the stop member mounted to the bezel begins to enter the recess of the case band. When the foot portion of the bezel is gradually forced into the case band, the protrusion of the bezel, which has been on the upper side of the stop member, gets under the stop member while causing the stop member to undergo elastic deformation so that the stop member may temporarily get deep into the recess. At this time, from the relative point of view, the stop member gets over the protrusion of the bezel while undergoing elastic deformation, and rotates from the lower side to the upper side of the protrusion. When getting over the protrusion, the stop member temporarily elastically extends, and, after getting over the protrusion, strives to be restored to the former configuration by its own elastic force. At this time, the upper portion of the stop member abuts the ceiling portion of the recess, and the lower portion of the stop member abuts the protrusion, with the result that the stop member is respectively engaged with the case band and the bezel. As a result, the bezel is mounted to the case band. The stop member is placed in a state in which it is accommodated between the bezel and the case band.

On the other hand, when detaching the bezel from the case band, the protrusion provided on the foot portion of the bezel moves from the lower side to the upper side of the stop member while causing the stop member to undergo elastic deformation so that the stop member may temporarily get deep into the recess. At this time, from the relative point of view, the stop member gets over the protrusion of the bezel, and rotates from the upper side to the lower side of the protrusion. As a result, the engagement between the stop member, the case band and the bezel is released, so that the bezel can be detached from the case band.

According to a second mode of the invention, there is provided the timepiece according to the first mode, wherein the bezel is provided with a support portion restricting a downward rotational range of the stop member such that when the bezel is not mounted to the case band and the bezel is placed in a horizontal state, the stop member is maintained at a predetermined position under the protrusion.

In this timepiece, when the bezel is not mounted to the case band and the bezel is placed in the horizontal state, the downward rotational range of the stop member is restricted by the support portion, and the stop member is maintained at a predetermined position under the protrusion. As a result, dangling of the stop member from the bezel is suppressed. Thus, when mounting the bezel to the case band, it is possible to suppress interference of the stop member with the hands and the dial mounted to the movement.

According to a third mode of the invention, there is provided the timepiece according to the first mode or the second mode, wherein a pair of stop members are provided on either side in the radial direction of the bezel.

In this timepiece, when mounting the bezel to the case band, the foot portion of the bezel is inserted into the case band and is gradually forced in, whereby the stop member is respectively engaged with the case band and the bezel on either side in the radial direction of the bezel. Thus, the operation of mounting the bezel to the case band is facilitated.

According to a fourth mode of the invention, there is provided the timepiece according to the first mode or the second mode, wherein the stop member is provided on one side in the radial direction of the bezel, and on the side of the bezel where the stop member is not provided, there is provided an engagement portion directly engaged with the case band.

In this timepiece, the engagement portion on the side of the bezel where the stop member is not provided is directly engaged with the case band, and then the side where the stop member is provided is forced into the case band, engaging the stop member respectively with the case band and the bezel. The stop member is provided on one side in the radial direction of the bezel, so that it is possible to achieve a reduction in the number of components as compared with the case where the stop member is provided on either side in the radial direction.

According to a fifth mode of the invention, there is provided the timepiece according to any one of the first through fourth modes, wherein the ceiling portion of the recess is inclined to the upper surface side of the case band toward the inner side in the radial direction of the case band; and the protrusion is formed in a sectional configuration tapered toward the outer side in the radial direction of the bezel.

In this timepiece, the ceiling portion of the recess of the case band is inclined, so that the stop member can easily get in and out of the recess. Further, the protrusion of the bezel is formed in a tapered sectional configuration, so that it is easy for the stop member to get over the protrusion. As a result, the attachment/detachment of the bezel with respect to the case band is facilitated.

According to a sixth mode of the invention, there is provided the timepiece according to any one of the first through fifth modes, wherein the stop member is provided with a planed growth portion constituting a margin for growth at the time of elastic deformation.

In this timepiece, the stop member is provided with the planned growth portion constituting the margin for growth at the time of elastic deformation, so that, as compared with the case where the planned growth portion is not provided, it is easier for the stop member to extend in the protruding direction of the protrusion when getting over the protrusion of the bezel.

DETAILED DESCRIPTION OF THE PREFERRED EMBODIMENTS

In the following, a mode for carrying out the present invention will be described with reference to the drawings.

First Embodiment

Figure 1:
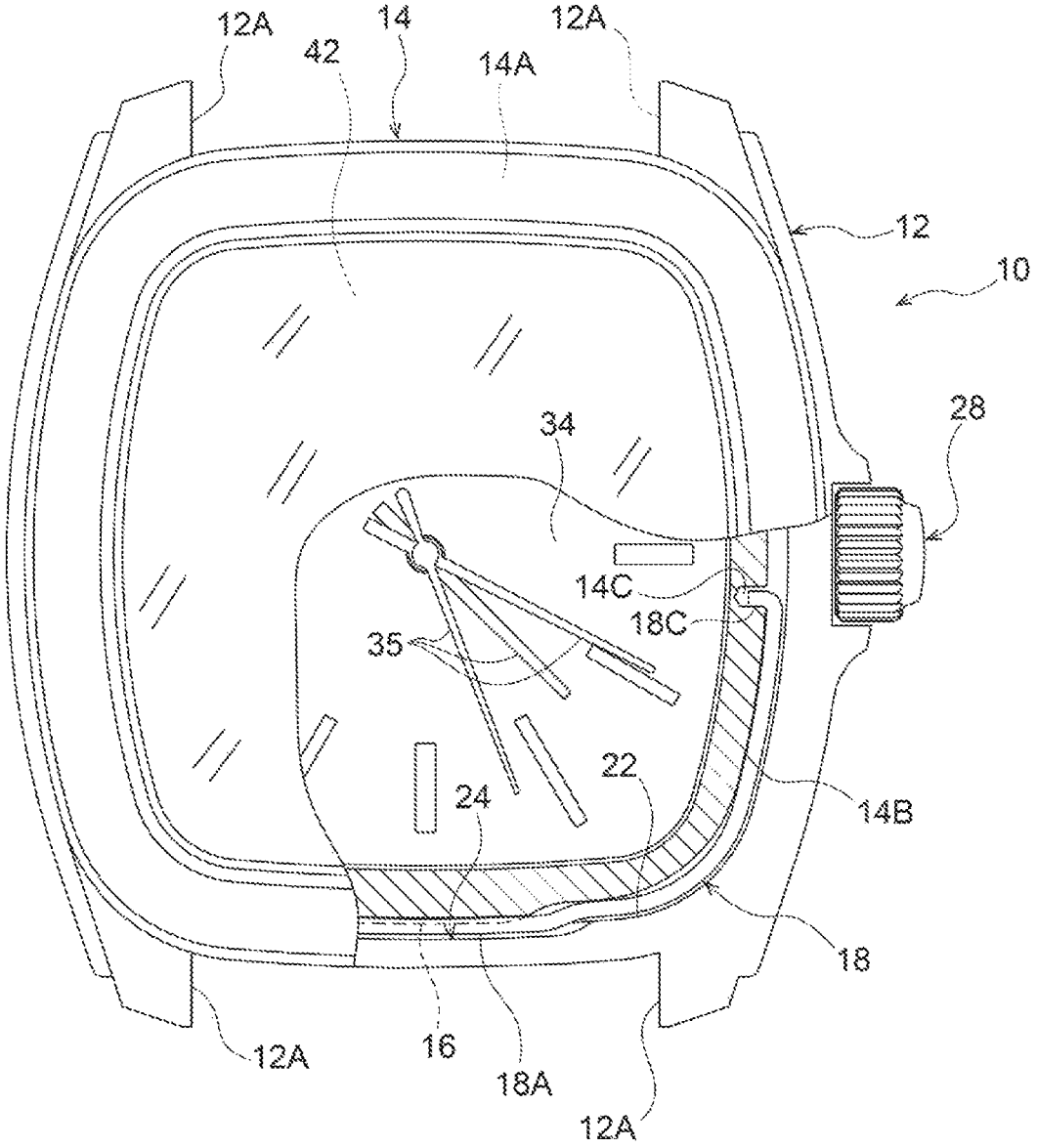
FIG. 1 is a front view, partly in section, of a timepiece according to a first embodiment.
Figure 2:
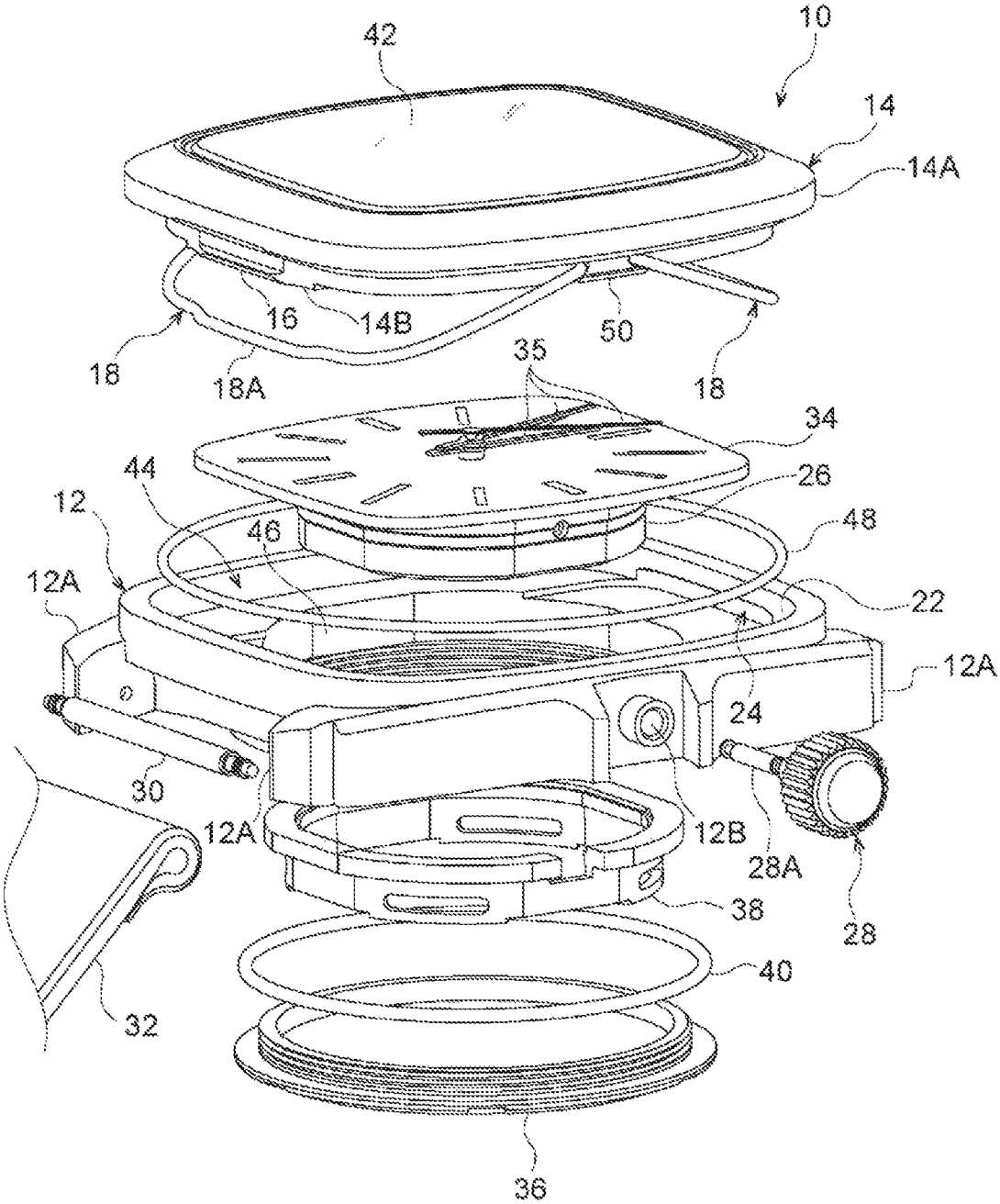
FIG. 2 is an exploded perspective view of the timepiece of the first embodiment.

Referring to FIGS. 1 and 2, a timepiece 10 according to the present embodiment is, for example, a wristwatch, and has a case band 12, a bezel 14 as an example of a bezel, a protrusion 16, and a stop member 18.

The case band 12 is a timepiece component which is open on the upper surface side, which has a recess 24 in an inner peripheral portion 22, and into which a movement 26 is put from the upper surface side. At both ends of the case band 12 in FIG. 1, there are respectively provided band mounting portions 12A. A wristband 32 is mounted to the band mounting portion 12A via a spring bar 30. As shown in FIG. 2, in a side surface of the case band 12, there is formed a hole 12B into which a shaft 28A of a crown 28 is inserted. This hole 12B extends through the inner peripheral portion 22 of the case band 12. Through this hole 12B, the shaft 28A of the crown 28 is connected to the movement 26 accommodated in the case band 12.

Figure 3:
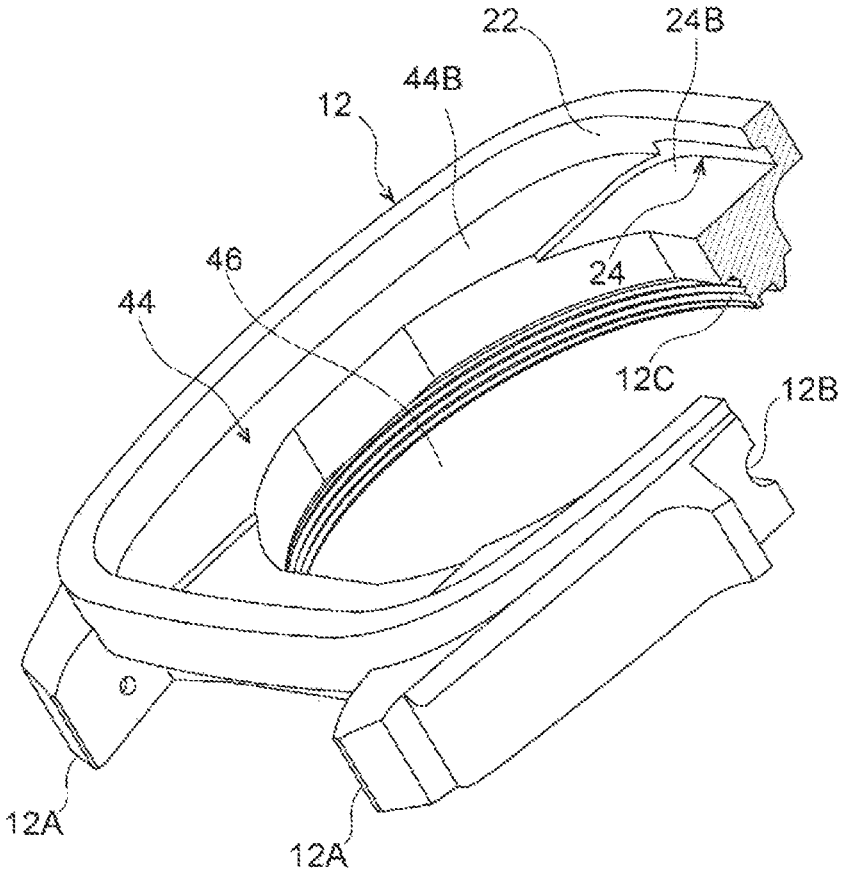
FIG. 3 is a perspective view, partly in section, illustrating the structure of a case band.

In FIGS. 2 and 3, the case band 12 is provided with a dial accommodating portion 44 accommodating a dial 34. In the dial accommodating portion 44, hands 35 mounted to the movement 26 are also accommodated. On the lower side of the dial accommodating portion 44, there is provided a movement accommodating portion 46 accommodating the movement 26. The movement accommodating portion 46 is formed in a tubular configuration in conformity with the outer configuration of the movement 26. On the lower side of the movement accommodating portion 46, there is formed, for example, a female screw 12C for mounting a case back 36. Here, the "lower side" means the back side (case back 36 side) of the timepiece 10.

In FIG. 2, in the dial accommodating portion 44, the movement 26 is set in position by a casing ring 38. Between the case back 36 and the case band 12, there is provided a case back packing 40 for securing the sealing property.

The inner peripheral portion 22 provided with the recess 24 is situated in the inner periphery of the dial accommodating portion 44. When the timepiece 10 is seen, for example, in plan view, the recess 24 is provided at each of the upper side (12 o'clock side of the timepiece 10) and the lower side (6 o'clock side of the timepiece 10). The recess 24 is, for example, a recessed groove recessed to the outer side in the radial direction from the inner peripheral portion 22 of the case band 12, and extends, for example, linearly or in an arcuate fashion in the width direction of the case band 12. This width direction is the lateral width direction when the timepiece is attached to the wrist, in other words, the direction connecting 3 o'clock and 9 o'clock of the dial 34.

Figure 6:
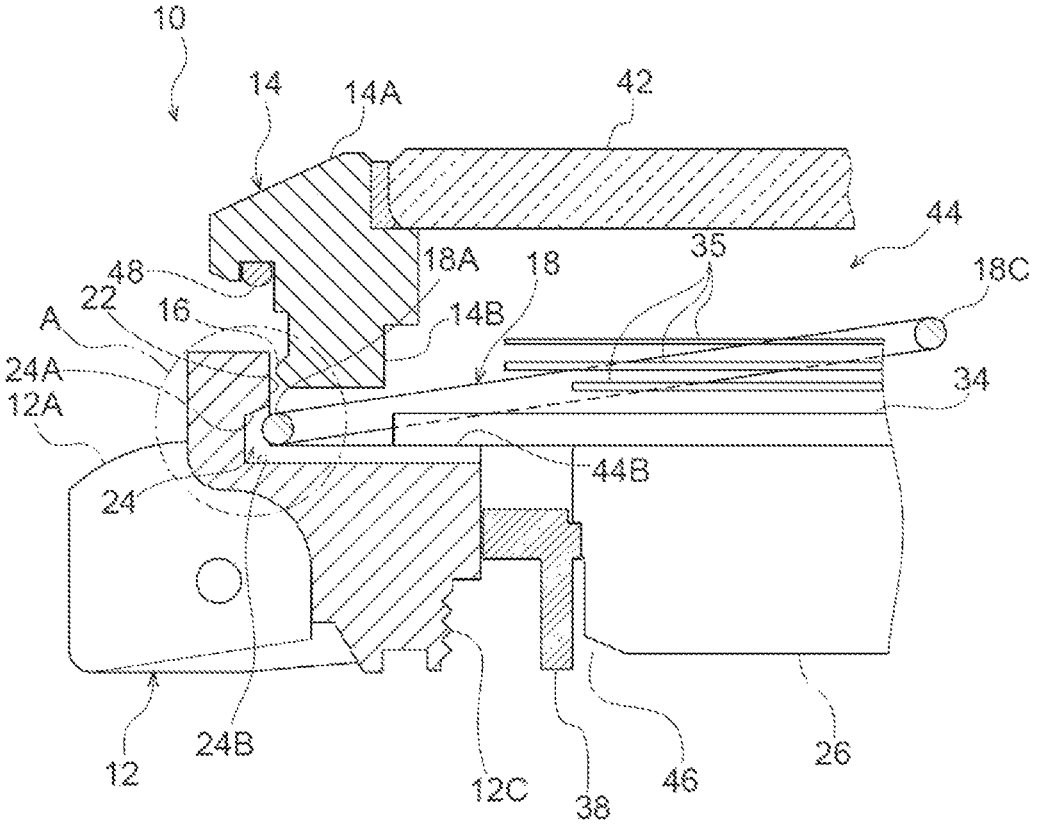
FIG. 6 is an enlarged sectional view illustrating a state before the fixation of the bezel to the case band.
Figure 7A:
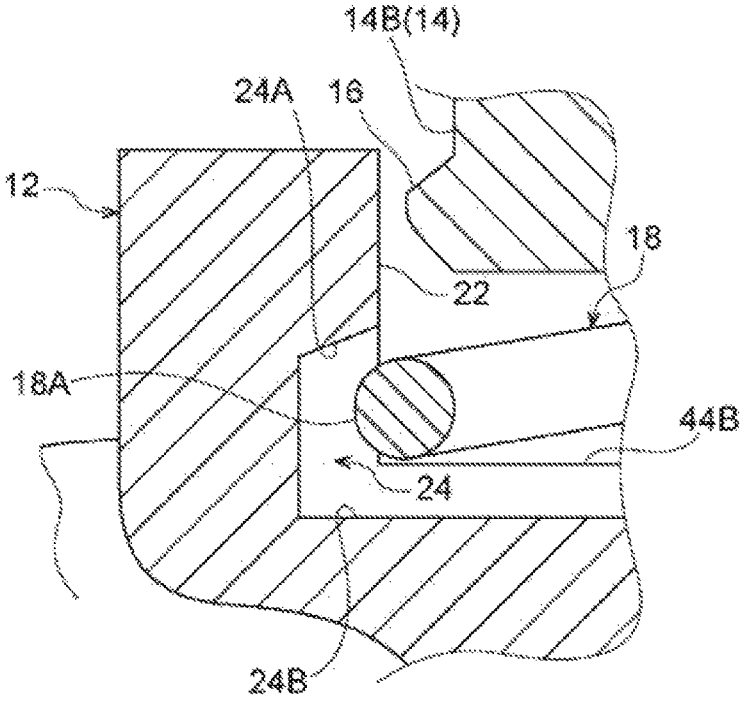
FIGS. 7A and 7B are enlarged sectional views of portion A of FIG. 6.
Figure 7B:
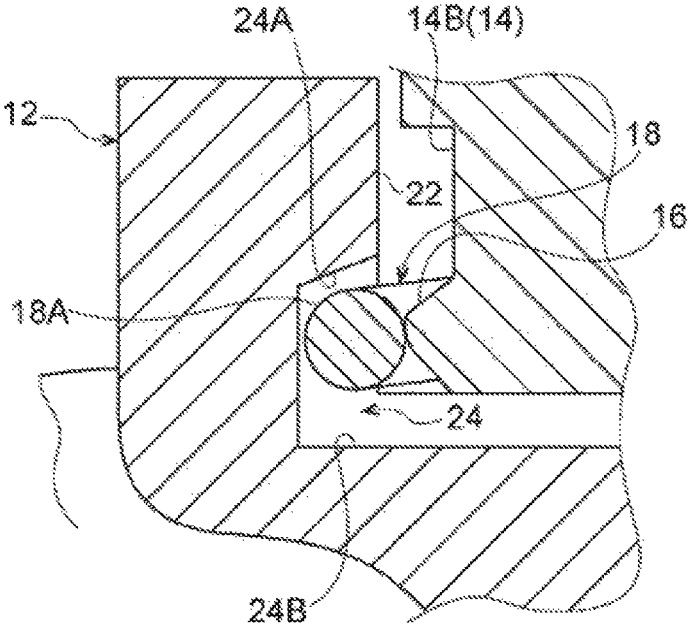

In the case where the configuration of the timepiece 10 is not square but round, the recess 24 may extend in the peripheral direction. In FIGS. 6, 7A and 7B, a ceiling portion 24A of the recess 24 is inclined to the upper surface side of the case band 12 toward the radially inner side of the case band 12. As a result, the ceiling portion 24A faces obliquely downward the central side of the case band 12. A bottom portion 24B of the recess 24 is formed one step lower than a bottom portion 44B of the dial accommodating portion 44, and is continuous with the inner side in the radial direction of the case band 12 to reach the movement accommodating portion 46.

Figure 4:
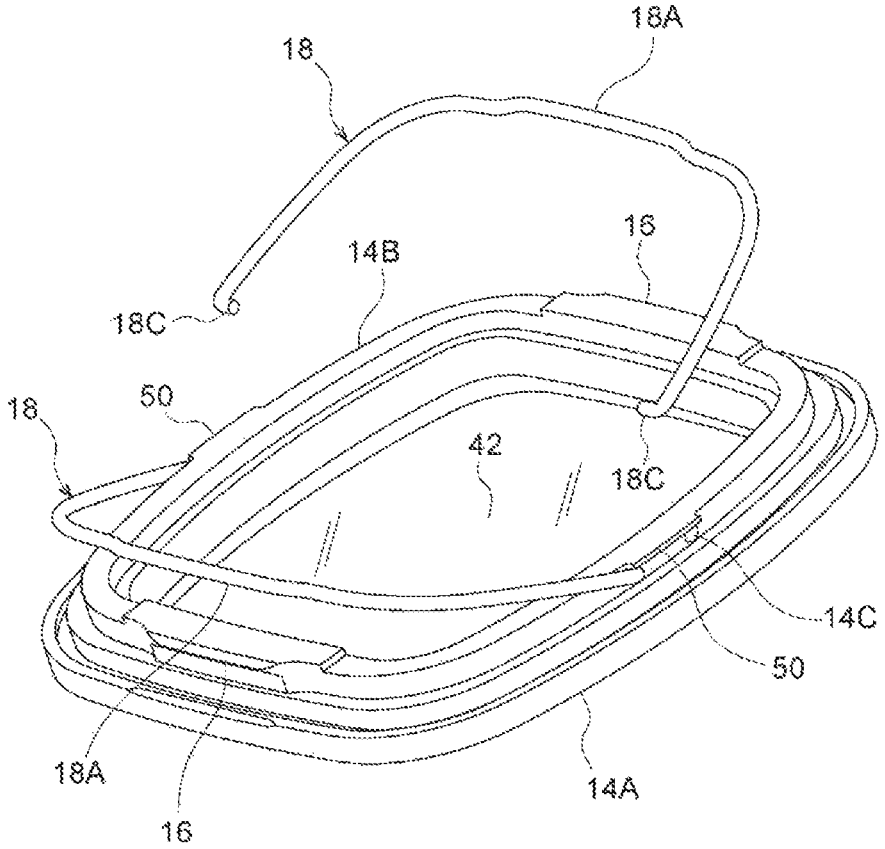
FIG. 4 is an exploded perspective view of a bezel and a stop member as turned over.

In FIGS. 1, 2, and 4, glass 42 as an example of the windshield is fixed to the bezel 14, which is mounted to the upper surface side of the case band 12. Between the bezel 14 and the case band 12, there is provided a bezel packing 48 for securing sealing property. FIG. 4 shows the bezel 14 as turned over. The bezel 14 has an edge portion 14A covering the case band 12 and constituting a design surface in the periphery of the glass 42. Further, the bezel 14 has a foot portion 14B as a portion to be inserted into the inner side of the case band 12. The windshield is not restricted to the glass 42 but any other transparent and hard material will do. For example, it may be a transparent resin.

The bottom portion 24B of the recess 24 is formed one step lower than the bottom portion 44B of the dial accommodating portion 44. In correspondence with this fact, the portion of the foot portion 14B having the protrusion 16 protrudes to the lower side (the upper side in FIG. 4) of the bezel 14 beyond the other portion.

Figure 8A:
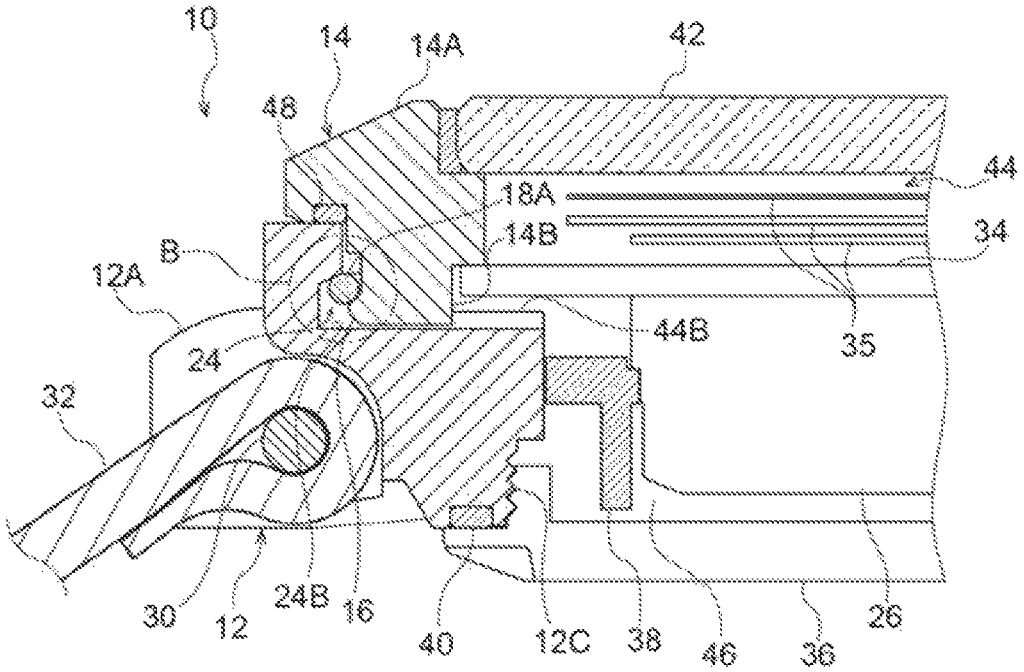
FIG. 8A is an enlarged sectional view illustrating the state in which the bezel has been fixed to the case band.
Figure 8B:
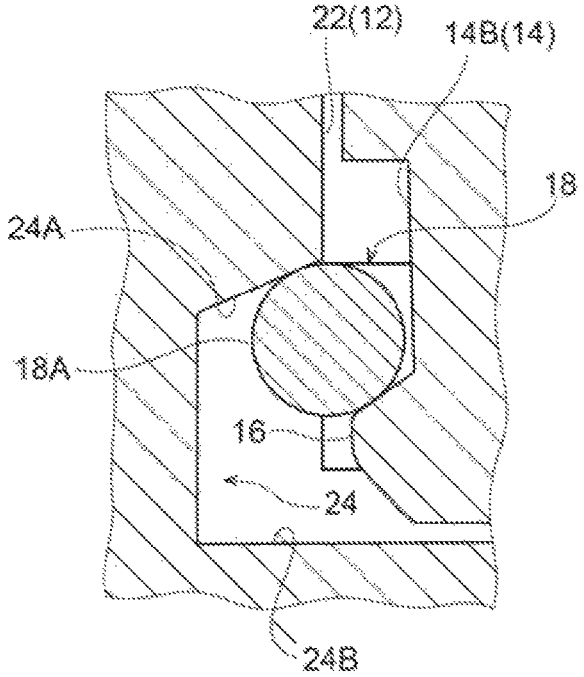
FIG. 8B is an enlarged sectional view of portion B of FIG. 8A.

In FIGS. 6, 7A and 7B, the protrusion 16 is provided on the foot portion 14B as the portion of the bezel 14 inserted into the inner side of the case band 12. It is a portion protruding toward the inner peripheral portion 22 so as not to enter the recess 24. The protrusion 16 is formed in a sectional configuration tapered (tapered toward the distal end) toward the outer side in the radial direction of the bezel 14. In other words, the protrusion 16 has an inclined surface on the upper side and the lower side. As shown in FIG. 1, the range of the protrusion 16 in plan view of the timepiece 10 is set to be smaller (shorter) than the range of the recess 24 of the case band 12. As shown in FIGS. 7B and 8B, the inclination angle of the upper surface of the protrusion 16 is different from the inclination angle of the ceiling portion 24A of the recess 24, whereby the distance between the protrusion 16 and the ceiling portion 24A of the recess 24 is reduced toward the inner side in the radial direction of the case band 12.

In FIGS. 2 and 4, the stop member 18 is rotatably mounted to the bezel 14, and gets over the protrusion 16 while undergoing elastic deformation to be thereby made swingable between the upper and lower sides of the protrusion 16. In the state in which the bezel 14 has been mounted to the case band 12, the upper portion of this stop member 18 abuts the ceiling portion of the recess 24, and the lower portion thereof abuts the protrusion 16, with the result that the stop member 18 is respectively engaged with the case band 12 and the bezel 14.

More specifically, the stop member 18 is formed by bending, for example, a metal wire line (piano line) in conformity with the outer configuration of the foot portion 14B of the bezel 14, for example, into a substantially C-shape. To suppress wear of the case band 12 and the bezel 14, it is desirable for the material of the stop member 18 to be softer than the material of the portions of the case band 12 and the bezel 14 coming into contact with the stop member 18. At the central portion in the width direction of the stop member 18, there is formed a protruding portion 18A partially protruding away from an insertion portion 18C described below (in the depth direction of the recess 24 of the case band 12). As shown in FIG. 1, the protruding portion 18A is of a configuration in conformity with the protrusion 16 of the bezel 14 and the recess 24 of the case band 12. The range of the protruding portion 18A is set to be wider (longer) than the range of the protrusion 16 of the bezel 14.

At both ends of the stop member 18, there are formed the insertion portions 18C by bending both ends of the wire line inwards in the width direction. On the other hand, in the side surface of each foot portion 14B of the bezel 14, there are formed, for example, two mounting holes 14C. By inserting the insertion portions 18C of the stop member 18 into the mounting holes 14C, the stop member 18 is mounted to the bezel 14. The stop member 18 is rotatable around the insertion portion 18C. A pair of stop members 18 are provided on either side in the radial direction of the bezel 14. In correspondence with this, the protrusion 16 of the bezel 14 and the recess 24 of the case band 12 are also provided respectively in pairs.

Further, a support portion 50 is provided on either side in the timepiece width direction of the bezel 14. The support portion 50 is a portion restricting the downward rotational range of the stop member 18 such that the stop member 18 is maintained at a predetermined position under the protrusion 16 when the bezel 14 is not mounted to the case band 12 and the bezel 14 is placed in the horizontal state. As shown in FIG. 4, the support portion 50 is formed integrally with the foot portion 14B such that it protrudes outwardly from the foot portion 14B. The support portion 50 protrudes at least on the lower side (the upper side in FIG. 4) of the insertion portion 18C of the stop member 18 so as to abut the stop member 18 at a position attained through rotation somewhat downwards of the stop member 18 when the bezel 14 is not mounted to the case band 12 and the bezel 14 is placed in the horizontal state.

Figure 5:
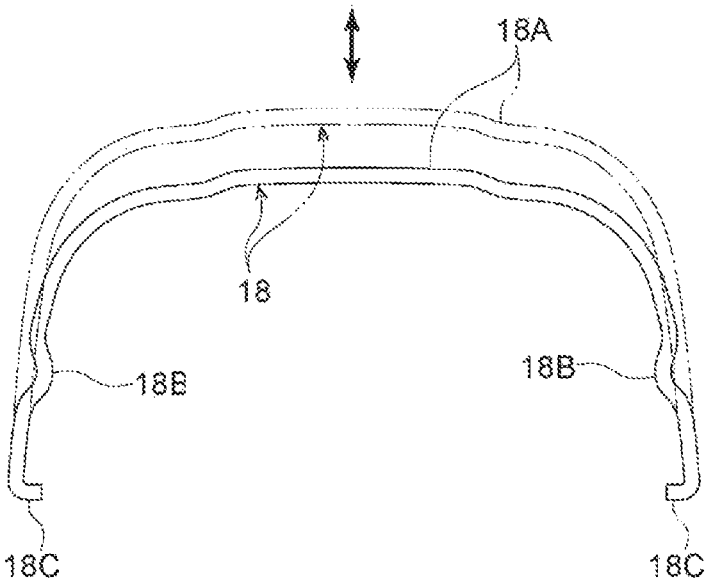
FIG. 5 is a front view of a stop member according to a first modification.

As in the case of modification 1 shown in FIG. 5, the stop member 18 may be provided with a planned growth portion 18B constituting a margin for growth at the time of elastic deformation. This planned growth portion 18B is a portion obtained by bending a part of the stop member 18 in a wave-like manner. For example, a pair of or a plurality of planned growth portions are provided for one stop member 18.

Figure 9A:
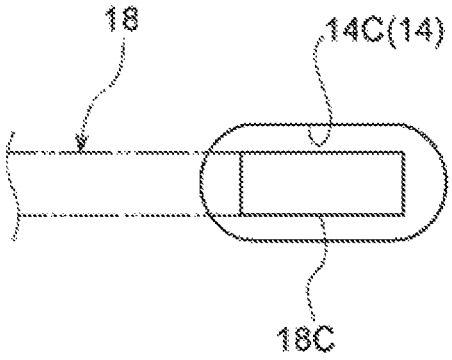
FIG. 9A is an enlarged sectional view of a stop member according to a second modification.
Figure 9B:
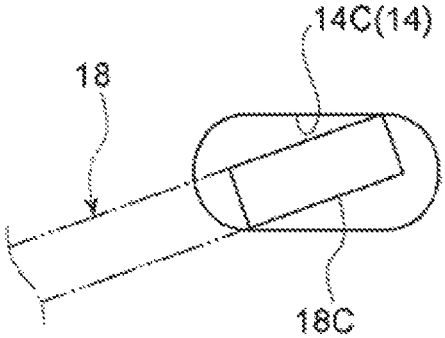
FIG. 9B is an enlarged sectional view illustrating a state in which the rotational range of the stop member with respect to the case band is restricted.

The stop member 18 and the mounting hole 14C may be formed as in the case of modification 2 shown in FIG. 9A. In this support portion 60, the insertion portion 18C of the stop member 18 is of a non-circular sectional configuration, for example, of a rectangular sectional configuration, and the mounting hole 14C is of a non-circular sectional configuration, for example, an elliptical configuration. The width of the mounting hole 14C is set to be somewhat larger than the width of the insertion portion 18C. As shown in FIG. 9B in this modification, the insertion portion 18C interferes with the mounting hole 14C when the stop member 18 rotates to a certain degree. Also in this structure, it is possible to restrict the rotational range of the stop member 18. That is, the support portion for restricting the rotational range of the stop member 18 may be realized in this structure. Further, the support portion may be of some other structure so long as it can restrict the rotational range of the stop member 18.

(Operation)

In the following, the operation of the present embodiment, which is of the above-described structure, will be described. In FIGS. 6 through 8B, in the timepiece 10 of the present embodiment, the stop member 18 is mounted to the bezel 14 so as to be rotatable around the insertion portion 18C. This stop member 18 can be easily mounted to the bezel 14 solely by inserting the insertion portion 18C into the mounting hole 14C of the bezel 14.

The movement 26 to which the dial 34 and the hands 35 are mounted is accommodated in the case band 12, and when mounting the bezel 14 to the case band 12, the foot portion 14B of the bezel 14 is inserted into the case band 12. At this time, the protrusion 16 provided on the foot portion 14B does not easily interfere with the inner peripheral portion 22 of the case band 12, so that wear due to contact between the bezel 14 and the case band 12 is not easily generated. Further, at this time, the stop member 18 mounted to the bezel 14 begins to enter the recess 24 of the case band 12 while sliding on the bottom portion 44B of the dial accommodating portion 44 or on the bottom portion 24B of the recess 24. More specifically, the protruding portion 18A of the stop member 18 begins to enter the recess 24.

As shown in FIGS. 7A, 7B, 8A and 8B, when the foot portion 14B of the bezel 14 is gradually forced into the case band 12, the protrusion 16 of the bezel, which has been on the upper side of the stop member 18, gets under the stop member 18 (FIGS. 8A and 8B) while causing the stop member 18 to undergo elastic deformation so that the protruding portion 18A of the stop member 18 may temporarily get deep into the recess 24 (FIG. 7B). At this time, from the relative point of view, with the stop member 18 undergoing elastic deformation, the protruding portion 18A thereof gets over the protrusion 16 of the bezel, and rotates from the lower side to the upper side of the protrusion 16.

The stop member 18 is of a C-shaped bent configuration, so that when getting over the protrusion 16, it temporarily elastically extends, and, after getting it over, strives to be restored to the former configuration due to the elastic force of its own. At this time, the upper portion of the protruding portion 18A of the stop member 18 abuts the ceiling portion 24A of the recess 24, and the lower portion of the stop member 18 abuts the protrusion 16, with the result that the stop member 18 is respectively engaged with the case band 12 and the bezel 14. As a result, the bezel 14 is mounted to the case band 12. The protruding portion 18A gets over the protrusion 16 by utilizing the elastic deformation of the stop member 18, so that wear is likely to occur. Further, the protrusion 16 of the bezel 14 is formed in a tapered sectional configuration, so that when the protruding portion 18A of the stop member 18 gets over the protrusion 16 and strives to be restored to the former configuration by the elastic force of its own, it is likely to abut the protrusion 16.

The inclination angle of the upper surface of the protrusion 16 is different from the inclination angle of the ceiling portion 24A of the recess 24, whereby the distance between the protrusion 16 and the ceiling portion 24A of the recess 24 is reduced toward the inner side in the radial direction of the case band 12. Thus, when the protruding portion 18A of the stop member 18 gets over the protrusion 16 and strives to be restored to the former configuration by the elastic force of its own, the protruding portion 18A abuts not only the protrusion 16 but also the ceiling portion 24A of the recess 24. As a result, the stop member 18 is not restored to its natural state but is constrained in a state in which it is somewhat deformed elastically. This helps to suppress generation of noise. Further, the protruding portion 18A abuts the upper side of the protrusion 16 due to the elastic force of the stop member 18, whereby it is possible to exert a downward force on the protrusion 16. As a result, the bezel 14 can be drawn into the lower side of the case band 12.

In the present embodiment, a pair of stop members 18 are provided on either side in the radial direction of the bezel 14, so that when mounting the bezel 14 to the case band 12, by forcing the foot portion 14B of the bezel 14 into the case band 12, the stop member 18 is respectively engaged with the case band 12 and the bezel 14 on either side in the radial direction of the bezel 14. Thus, the operation of mounting the bezel 14 to the case band 12 is facilitated.

On the other hand, when detaching the bezel 14 from the case band 12, the protrusion 16 provided on the foot portion 14B of the bezel 14 moves from the lower side to the upper side of the stop member 18 while causing the stop member 18 to undergo elastic deformation so that the stop member 18 may temporarily get deep into the recess 24. At this time, from the relative point of view, the stop member 18 gets over the protrusion 16 of the bezel 14 and rotates from the upper side to the lower side of the protrusion 16. As a result, the engagement between the stop member 18 and the case band 12 and the bezel 14 is released, so that it is possible to detach the bezel 14 from the case band 12.

If the stop member 18 has been worn due to the attachment/detachment of the bezel 18 with respect to the case band 12, it is only necessary to replace the stop member 18. Since the stop member 18 is an inexpensive component formed by bending a wire line, it is possible to suppress the replacement cost.

As shown in FIG. 2, when the bezel 14 is not mounted to the case band 12 and the bezel 14 is placed in the horizontal state, the downward rotational range of the stop member 18 is restricted by the support portion 50, and the stop member 18 remains at the predetermined position under the protrusion 16. This helps to suppress dangling of the stop member 18 from the bezel 14. Thus, when mounting the bezel 14 to the case band 12, it is possible to suppress interference of the stop member 18 with the hands and the dial mounted to the movement 26.

Further, as shown in FIGS. 7A, 7B, 8A and 8B, the ceiling portion 24A of the recess 24 of the case band 12 is inclined, so that the stop member 18 can easily get in and out of the recess 24. Since the protrusion 16 of the bezel 14 is formed in a tapered sectional configuration, the stop member 18 can easily get over the protrusion 16. Thus, the attachment/detachment of the bezel 14 with respect to the case band 12 is facilitated.

The stop member 18 of modification 1 shown in FIG. 5 is provided with the planned growth portion 18B constituting a margin for growth at the time of elastic deformation, so that, as compared with the case where there is no planned growth portion 18B, when the stop member 18 gets over the protrusion 16 of the bezel 14, it can extend more easily in the protruding direction of the protrusion 16.

In this way, in the present embodiment, it is possible to comfortably repeat the opening and closing of the bezel 14 with respect to the case band 12, making it possible to achieve an improvement in terms of timepiece maintenance property.

In the case where the bezel is fixed to the case band by using a machine screw, a female screw for fastening the machine screw is cut in the foot portion of the bezel, so that the bezel must be endowed with a rather large width, making it impossible for the dial to show itself large, which affects visibility. The case band must also be provided with a through-hole through which the screw is to be passed, and to hide the screw, it is necessary to arrange the screw, for example, on the upper surface of the wristband.

In this respect, in the present embodiment, there is no need to provide a machine screw, so that as compared with the case where the machine screw is employed, the edge width of the bezel 14 can be relatively thinner. Thus, it is possible for the dial 34 to appear larger, thereby achieving an improvement in terms of visibility. Further, the stop member 18 is accommodated between the bezel 14 and the case band 12 so as to avoid waste in terms of space, so that no surplus space is required inside the timepiece 10. Thus, it is also possible to secure the arrangement space for the wristband 32 under the bezel 14.

Second Embodiment

Figure 10:
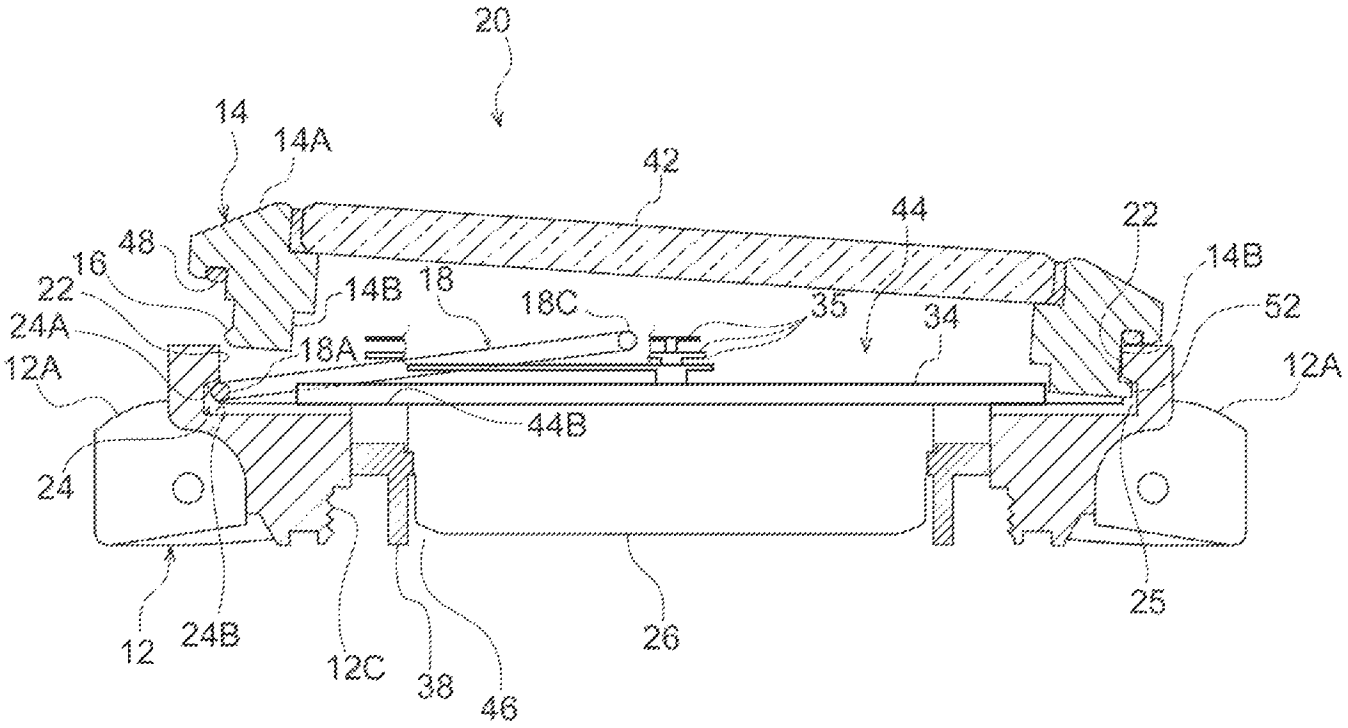
FIG. 10 is an enlarged sectional view of a timepiece according to a second embodiment, illustrating the state before the fixation of the bezel to the case band.
Figure 11:
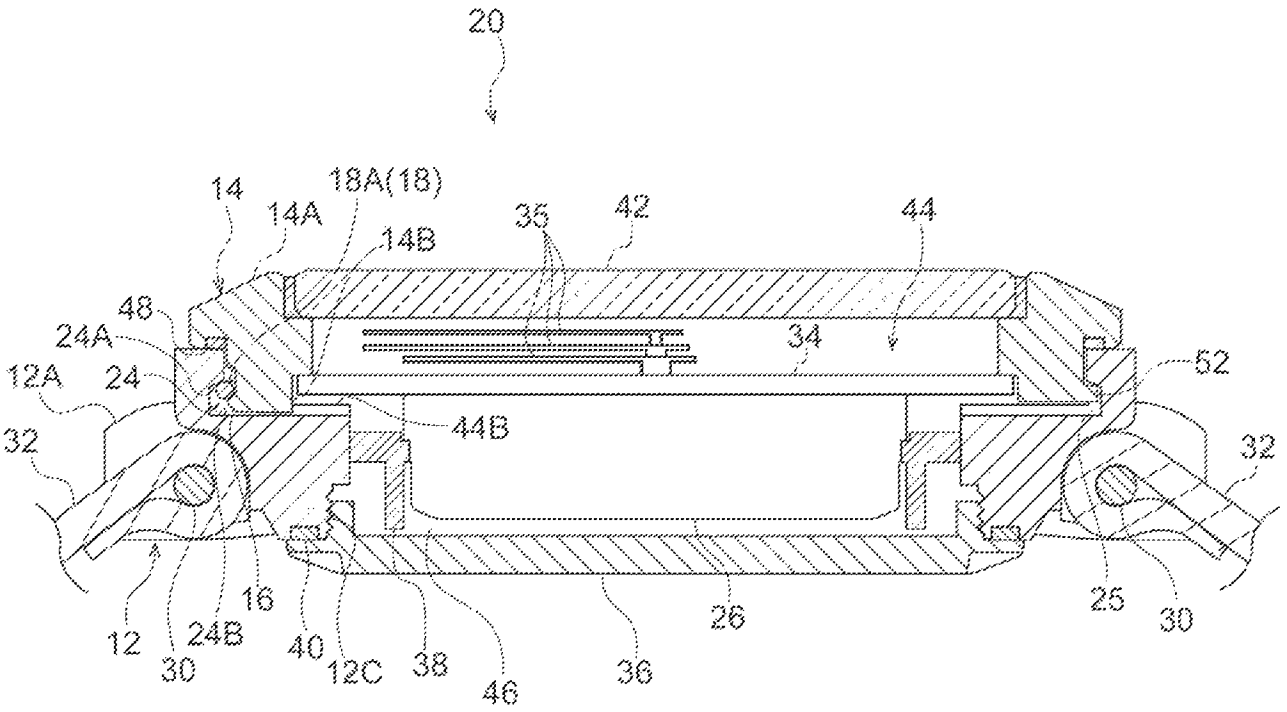
FIG. 11 is an enlarged sectional view of the timepiece of the second embodiment, illustrating the state in which the bezel has been fixed to the case band.

In FIGS. 10 and 11, in a timepiece 20 according to the present embodiment, the stop member 18 is provided on one side in the radial direction of the bezel 14. For example, it is provided on the upper side (12 o'clock side of the dial 34) or on the lower side (6 o'clock side of the dial 34) of the timepiece 20.

On the side of the bezel 14 where the stop member 18 is not provided, and more specifically, on the side in the radial direction of the bezel 14 opposite the protrusion 16, there is provided an engagement portion 52 directly engaged with a recess 25 of the case band 12. The engagement portion 52 is provided on the foot portion 14B. The engagement portion 52 is a protrusion of a configuration such as will enter the recess 25 with the outer surface of the foot portion 14B being held in contact with the inner peripheral portion 22. The protrusion 16 engaged with the stop member 18 protrudes toward the inner peripheral portion 22 of the case band 12 so as not to enter the recess 24, whereas the engagement portion 52 protrudes to a position where it enters the recess 25. That is, the engagement portion 52 protrudes farther than the protrusion 16.

As shown in FIG. 10, in the timepiece 20 of the present embodiment, the engagement portion on the side of the bezel 14 where the stop member 18 is not provided is directly engaged with the case band 12, and then the side where the stop member 18 is provided is forced into the case band 12, thereby engaging the stop member 18 respectively with the case band 12 and the bezel 14 (FIG. 11). The stop member 18 is provided on one side in the radial direction of the bezel 14, so that, as compared with the case where the stop member 18 is provided on either side in the radial direction, it is possible to reduce the number of components.

The engagement of the stop member 18 and the case band 12 and the bezel 14 and the release thereof at the time of attachment/detachment of the bezel 14 are the same as those in the first embodiment. The portions that are the same as those of the first embodiment are indicated by the same reference numerals in the drawings, and a description thereof will be left out.

OTHER EMBODIMENTS

The present invention is not restricted to the embodiments described above by way of example. It goes without saying that the present invention can be carried out in various modifications without departing from the scope of the gist of the invention.

While in the above description the recess 24 is a recessed groove extending in the width direction of the case band 12, the recessed groove may be provided intermittently at a plurality of portions. Further, the recess 24 is not restricted to a recessed groove but may be one or more local recesses. A combination of a recessed groove and a local recess is also possible.

While in the above description the protrusion 16 is of a tapered sectional configuration the upper and lower surfaces of which are inclined, the upper and lower surfaces are not restricted to flat surfaces but may also consist of curved surfaces. Further, the upper and lower surfaces of the protrusion 16 may consist of a combination of a flat surface and a curved surface.

What is claimed is:

1. A timepiece comprising:

a case band having an opening on an upper surface side thereof, and a recess in an inner peripheral portion thereof;

a bezel to which a windshield is fixed, wherein the bezel is mounted to the upper surface side of the case band;

a protrusion provided at a portion of the bezel inserted into an inner side of the case band, wherein the protrusion protrudes toward the inner peripheral portion so as not to enter the recess; and a stop member rotatably mounted to the bezel, wherein the stop member is swingable between an upper side and a lower side of the protrusion by getting over the protrusion while undergoing elastic deformation, and wherein an upper portion of the stop member abuts a ceiling portion of the recess and a lower portion of the stop member abuts the protrusion in a state in which the bezel is mounted to the case band to be respectively engaged with the case band and the bezel.

2. The timepiece according to claim 1, wherein the bezel is provided with a support portion restricting a downward rotational range of the stop member such that when the bezel is not mounted to the case band and the bezel is placed in a horizontal state, the stop member is maintained at a predetermined position under the protrusion.

3. The timepiece according to claim 1, wherein a pair of stop members are provided on either side in the radial direction of the bezel.

4. The timepiece according to claim 1, wherein the stop member is provided on one side in the radial direction of the bezel, and on a side of the bezel where the stop member is not provided, there is provided an engagement portion directly engaged with the case band.

5. The timepiece according to claim 1, wherein the ceiling portion of the recess is inclined to the upper surface side of the case band toward the inner side in the radial direction of the case band; and the protrusion is formed in a sectional configuration tapered toward the outer side in the radial direction of the bezel.

6. The timepiece according to claim 1, wherein the stop member is provided with a planed growth portion constituting a margin for growth at the time of elastic deformation.

* * * * *